US010337484B2

(12) United States Patent
Florijancic et al.

(10) Patent No.: US 10,337,484 B2
(45) Date of Patent: Jul. 2, 2019

(54) STARTER FOR AN INTERNAL COMBUSTION ENGINE

(71) Applicant: Mahle International GmbH, Stuttgart (DE)

(72) Inventors: Tadej Florijancic, Most Na Soci (SI); Sebastjan Kobal, Sempas (SI)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 15/761,083

(22) PCT Filed: Sep. 14, 2016

(86) PCT No.: PCT/EP2016/071645
§ 371 (c)(1),
(2) Date: Mar. 16, 2018

(87) PCT Pub. No.: WO2017/046130
PCT Pub. Date: Mar. 23, 2017

(65) Prior Publication Data

US 2018/0274511 A1 Sep. 27, 2018

Related U.S. Application Data

(63) Continuation of application No. PCT/EP2016/071645, filed on Sep. 14, 2016.

(30) Foreign Application Priority Data

Sep. 18, 2015 (EP) ..... 15185789

(51) Int. Cl.
*F02N 15/06* (2006.01)
*F02N 11/08* (2006.01)
(Continued)

(52) U.S. Cl.
CPC ..... *F02N 15/067* (2013.01); *F02N 11/087* (2013.01); *H01F 7/081* (2013.01);
(Continued)

(58) Field of Classification Search
CPC .. F02N 15/067; F02N 11/087; F02N 11/0851; F02N 2015/061; H01F 7/081;
(Continued)

(56) References Cited

U.S. PATENT DOCUMENTS 2,419,333 A * 4/1947 Christiansen ..... H01F 7/1607 335/263
5,563,563 A * 10/1996 Freitas ..... H01H 1/04 335/126

(Continued)

FOREIGN PATENT DOCUMENTS

| | | | |
|---|---|---|---|
| DE | 102012223997 | A1 | 6/2014 |
| EP | 1903581 | A2 | 3/2008 |
| FR | 2294335 | A2 | 7/1976 |

OTHER PUBLICATIONS

English abstract for FR-2822164.
English abstract for DE-102012223997.

*Primary Examiner* — Mahmoud Gimie
(74) *Attorney, Agent, or Firm* — Fishman Stewart PLLC

(57) ABSTRACT

A starter for an internal combustion engine may include a support, an electric motor for driving a pinion in rotation, and a solenoid drive configured to axially adjust the pinion between an active position for driving a gearwheel of an internal combustion engine, and an axially offset passive position. The solenoid drive may include a ferromagnetic solenoid housing fastened to the support, a ferromagnetic plunger stop arranged one of in and at the solenoid housing, a ferromagnetic plunger axially adjustable relative to the plunger stop extending axially through a passage opening of a face side wall of the solenoid housing, and a cylindrical
(Continued)

coil arrangement arranged in the solenoid housing surrounding a cylindrical coil interior in a circumferential direction. The plunger stop may include a cylindrical section projecting axially into the coil interior. The cylindrical section may have a face end facing towards the face side wall.

20 Claims, 2 Drawing Sheets

(51) Int. Cl.

| | |
|---|---|
| ***H01F 7/08*** | (2006.01) |
| ***H01F 7/121*** | (2006.01) |
| ***H01H 51/06*** | (2006.01) |
| ***H01F 7/16*** | (2006.01) |

(52) U.S. Cl.
CPC ..... *H01F 7/121* (2013.01); *H01F 7/16* (2013.01); *H01F 7/1607* (2013.01); *H01H 51/065* (2013.01); *F02N 11/0851* (2013.01); *F02N 2011/0874* (2013.01); *F02N 2015/061* (2013.01); *H01F 2007/086* (2013.01)

(58) Field of Classification Search
CPC ..... H01F 7/121; H01F 7/16; H01F 7/1607; H01F 2007/086
USPC ..... 123/179.25; 251/129.15, 129.16
See application file for complete search history.

(56) References Cited

U.S. PATENT DOCUMENTS

| | | | | |
|---|---|---|---|---|
| 8,421,565 | B2 | 4/2013 | Santichen et al. | |
| 2004/0032309 | A1 | 2/2004 | Kajino et al. | |
| 2006/0038645 | A1* | 2/2006 | Hoffman ..... | H01F 7/1607 335/220 |
| 2010/0271155 | A1 | 10/2010 | Kaneda et al. | |
| 2015/0219059 | A1 | 8/2015 | Fujita et al. | |

* cited by examiner

STARTER FOR AN INTERNAL COMBUSTION ENGINE

CROSS-REFERENCE TO RELATED APPLICATIONS

This application claims priority to International Patent Application No. PCT/EP2016/071645, filed on Sep. 14, 2016, and European Patent Application No. EP 15185789.3, filed on Sep. 18, 2015, the contents of both of which are hereby incorporated in their entirety.

TECHNICAL FIELD

The present invention relates to a starter for an internal combustion engine.

BACKGROUND

A starter of said type comprises a support, an electric motor which is arranged on the support and which serves for driving a pinion in rotation, and a solenoid drive which is arranged on the support and which serves for the axial adjustment of the pinion between an active position, which is provided for the drive of a gearwheel of the internal combustion engine, and a passive position, which is axially offset with respect to the active position. The solenoid drive comprises a plunger stop which is static with respect to the support, a plunger which is axially adjustable relative to the plunger stop, and a cylindrical coil arrangement which is arranged on the plunger stop and which surrounds a cylindrical coil interior of the coil arrangement in a circumferential direction. Furthermore, the plunger stop has a cylindrical section which projects axially into the coil interior.

For the starting of the internal combustion engine, the solenoid drive is activated so as to transfer the pinion of the electric motor from the passive position into the active position. In the active position, the pinion meshes with a gearwheel of the internal combustion engine, which may be formed for example on a flywheel of a drivetrain of the internal combustion engine. The electric motor then drives the pinion, which in turn drives said gearwheel, whereby a crankshaft of the internal combustion engine is set in rotation in order to start the internal combustion engine. When the internal combustion engine has started and its crankshaft is driven by reciprocating movements of the pistons of the internal combustion engine, the solenoid drive is operated such that the pinion is returned from the active position into the passive position. In the passive position, the pinion disengages from said gearwheel, that is to say no longer meshes with the latter.

To be able to adjust the pinion from the passive position into the active position and to be able to hold the pinion fixed in the active position, the coil arrangement must provide relatively large magnetomotive force in order to draw the plunger into the coil interior, and hold it there, for the active position. Since, for the purposes of a failsafe design, the plunger is preferably drawn into the coil interior counter to the action of a restoring spring, relatively high magnetic forces are required in particular to hold the plunger static in the active position of the pinion, such that the coil arrangement is supplied with a correspondingly high level of electrical power.

The pinion normally has a circumferential toothing with axially extending teeth. Complementary with respect to this, the gearwheel of the internal combustion engine likewise has a circumferential toothing with axially running teeth.

Upon a transfer of the pinion from the passive position into the active position, the teeth of the pinion engage into tooth spaces of the gearwheel. However, in many situations, axially leading tooth flanks of the teeth of the pinion do not pass directly into the tooth spaces of the toothing of the gearwheel but strike axial tooth flanks of the teeth of the gearwheel. In order that the teeth of the pinion nevertheless find their way into the tooth spaces of the gearwheel and can engage therein, the electric motor of the starter may be actuated so as to effect a rotation of the pinion already during the adjustment of the pinion from the passive position into the active position. Said rotation for the threading-in of the pinion into the gearwheel is expediently performed with a considerably reduced torque and/or with a considerably reduced rotational speed in relation to the subsequent starting process, when the pinion is fully engaged with the gearwheel.

Owing to the relatively high magnetic force with which the plunger is drawn into the coil interior, as described above, the pinion may, by way of its axially leading tooth flanks, collide with the opposite axial tooth flanks of the gearwheel with corresponding intensity, increasing the wear of the toothings of pinion and gearwheel. Furthermore, the toothings may bear against one another by way of the axial tooth flanks with a relatively high force, whereby a correspondingly high level of friction must be overcome in order to rotate the pinion relative to the gearwheel such that the toothing of the pinion can mesh with the toothing of the gearwheel. As a result, there is the risk of increased wear here too.

A generic starter is known for example from U.S. Pat. No. 8,421,565 B2. To solve the abovementioned problem, in the case of a known starter, said document proposes a complex construction of the coil arrangement within the solenoid drive, wherein a retraction coil for pulling the plunger into the coil interior and a holding coil for holding the plunger that has been pulled into the coil interior are arranged axially separately from one another. It is also proposed that the plunger be equipped, on its outer circumference, with an encircling groove which, in the passive position, is situated radially opposite an edge region circumferentially surrounding a passage opening, through which the plunger extends axially, of a face side wall of a solenoid housing. In this way, in the passive position, there is a radial gap between plunger and edge region. As the plunger is retracted into the coil interior, the circumferential groove moves into the coil interior and thereby departs from the abovementioned edge region of the face side wall, such that said edge region is subsequently situated radially opposite a plunger longitudinal section adjoining the circumferential groove. As the plunger is retracted, therefore, a radial spacing between said edge region and an outer side of the plunger is varied, specifically reduced, whereby the density of the magnetic field lines transmitted from said edge region to the plunger when the coil arrangement is activated is varied, specifically increased. The density of the magnetic field lines however correlates with the acting magnetic forces. The circumferential groove formed on the plunger thus yields a reduction in the acting magnetic forces at the start of the retraction movement of the plunger when the pinion is to be transferred from the passive position into the active position. The known measures are however relatively cumbersome to realize. Furthermore, the attractive force that pulls the plunger into the coil interior is reduced only to a relatively small extent by the annular groove, as said annular groove ultimately merely effects a deflection of the field lines. Also, the annular groove is maintained and, even when the plunger has been retracted into the coil interior, causes a deflection of the field lines in the plunger, thus reducing the attainable magnetic forces.

SUMMARY

The present invention is concerned with the problem of specifying, for a starter of the type mentioned in the introduction, an improved or at least different embodiment which is characterized by reduced wear of the pinion and/or of the gearwheel that interacts therewith. In particular, it is sought to specify an advantageous or alternative way of reducing the acting magnetic forces at the start of the adjustment of the pinion between the passive position and the active position.

Said problem is solved according to the invention by means of the features of the independent claim(s). The dependent claim(s) relate to advantageous embodiments.

Here, the invention is, in accordance with a first aspect of the inventive solution, based on the general concept of providing a cylindrical chamber in the cylindrical section of the plunger stop. The plunger protrudes axially into said cylindrical chamber. The cylindrical section preferably protrudes so far axially into the coil interior that the plunger protrudes axially into the cylindrical chamber both in the active position and in the passive position of the pinion. Thus, axial guidance for the plunger in the cylindrical section is realized over the entire adjustment travel of the plunger.

Since, according to this proposal, the plunger which is composed in particular of a ferromagnetic material protrudes into the cylindrical chamber of the cylindrical section of the plunger stop, the plunger, at least in a position assigned to the passive position of the pinion, has a plunger section which is situated axially outside the cylindrical section and which is at a relatively large radial spacing to a circumferential enclosure of the coil interior or from a solenoid housing in which the coil arrangement is accommodated, whereby an annular free space is generated radially between the plunger and solenoid housing. Said free space has the effect that, in the passive position, the magnetic flux passed from the solenoid housing through the plunger into the cylindrical section of the plunger stop upon the activation or energization of the coil arrangement is, in effect, interrupted, or at least greatly reduced. Accordingly, the magnetic forces acting on the plunger at the start of the adjustment movement are also reduced. The greater the extent to which the plunger protrudes into the cylindrical chamber during the course of the adjustment movement, the smaller the above-mentioned free space becomes in the axial direction, whereby the interrupting or reducing action of the free space on the magnetic flux correspondingly decreases. As a result, the magnetic force acting on the plunger increases as the plunger protrudes into the cylindrical chamber.

The plunger, cylindrical section and cylindrical chamber can now be coordinated with one another in a particularly simple manner such that, during an adjustment movement of the pinion from the passive position into a position in which axial contact can occur between the axial tooth flanks of the pinion and the axial tooth flanks of the gearwheel, the axial advancing force acting on the pinion is significantly reduced, and considerably increases only when the teeth of the pinion protrude into the tooth spaces of the gearwheel. The risk of damage to the pinion or to the gearwheel can thereby be significantly reduced.

Here, the invention is, in accordance with a second aspect of the inventive solution, based on the general concept of axially lengthening the cylindrical section, which projects into the coil interior, of the plunger stop such that said cylindrical section extends axially over a significant section of the coil interior. A "significant section" of the coil interior is to be understood in the present context to mean a section which extends over at least 50% of an axial length of the coil interior. Accordingly, the cylindrical section of the plunger stop extends over at least 50%, preferably over at least 75% and in particular over at least 90% of the axial length of the coil interior. In other words, the invention is based on the idea to extend the cylindrical section of the plunger stop into proximity of the face side wall of the solenoid housing. In more detail, said cylindrical section has a face end facing towards the face side wall of the solenoid housing, and said coil interior consists axially of a proximal half section and a distal half section, said proximal half section being closer to the face side wall of the solenoid housing than the distal half section. The present invention proposes to arrange the face end of the cylindrical section in the proximal half section of the coil interior.

This proposed arrangement of the face end of the cylindrical section within the proximal half section of the coil interior causes, when the pinion is in the passive position, a significant reduction of magnetic forces acting on the plunger at the start of the adjustment movement. Since the face end of the cylindrical section is arranged in the proximal half section of the coil interior, the distance between said face end and the face side wall of the solenoid housing also is significantly reduced, and the position of the plunger in the passive position of the pinion is also shifted towards said face side wall. This changed position of the plunger in the passive position together with this reduced distance between said ferromagnetic face side wall of the ferromagnetic solenoid housing and said face end of the ferromagnetic cylindrical section of the ferromagnetic plunger stop causes a deviation of a significant portion of the magnetic flux in such a way, that said portion of magnetic flux bypasses the plunger and goes directly from the face side wall to the face end. This deviated portion of magnetic flux thus cannot induce magnetic force into the plunger. Therefore, the magnetic force acting on the plunger at the start of the adjustment movement is correspondingly reduced. On the other hand, during the adjustment movement of the plunger this deviation of magnetic flux bypassing the plunger decreases while the magnetic force acting on the plunger increases. Finally, in the active position of the pinion the maximum magnetic force acts on the plunger.

According to a preferred embodiment the cylindrical section extends over more than 50% of an axial length of the coil arrangement. Preferably, the cylindrical section extends over at least 60%, or at least 70%, or at least 75%, or at least 80%, or at least 90% of the axial length of the coil arrangement.

The aforementioned first and second aspects of the present invention can be realized alternatively or cumulatively, wherein the latter is preferred. Embodiments of the present invention, which are described in the following, can be combined with the first aspect of the present invention and/or with the second aspect of the present invention.

According to an embodiment, at least in the passive position of the pinion, an axial gap is provided between said face end of the cylindrical section and a portion of the plunger, wherein, when the plunger is moving in order to move the pinion from the passive position into the active position, said portion of the plunger moves towards said face end of the cylindrical section in order to axially reduce said gap, wherein said gap is arranged proximal to the face side wall of the solenoid housing.

According to another embodiment the face side wall has an inner side facing towards the coil arrangement, wherein, in the passive position of the pinion, said gap axially overlaps a radially inner edge of said inner side. Consequently, the portion of the plunger facing and interacting with the face end of the cylindrical section is arranged outside of the coil interior, when the pinion is in its passive position. Therefore, the portion of the magnetic flux bypassing the plunger is increased.

In accordance with one advantageous embodiment of the invention, the solenoid drive may have a solenoid housing which is fastened to the support and which, in a face side wall, has a passage opening extended through axially by the plunger. The solenoid housing is expediently produced from a magnetically conductive ferromagnetic material, preferably from iron. The coil arrangement is accommodated in the solenoid housing. Via the solenoid housing, a circuit for the magnetic field lines via the plunger and the plunger stop can be realized.

In one advantageous refinement, the face side wall may, in an edge region bordering the passage opening in the circumferential direction, be spaced apart axially from a face side, facing toward the face side wall, of the cylindrical section. In other words, that face end of the cylindrical section which faces towards the face side wall is, at least radially at the outside, spaced apart axially from said edge region of the face side wall. Furthermore, said edge region, at least radially at the inside, is arranged axially outside the coil interior. In this way, there is a physical interruption between the solenoid housing and the plunger stop in the region of the face end and of the edge region. Owing to this interruption, which is delimited at one side by the edge region of the face side wall of the solenoid housing and at the other side by the face end of the cylindrical section of the plunger stop, only a portion of the magnetic field lines runs through the plunger, while a significant portion of the magnetic field lines bypasses the plunger, when at the beginning of the movement the coil arrangement is energized and when the pinion is in its passive position.

In another advantageous refinement, the plunger may have a protrusion section, which protrudes axially into the cylindrical chamber, a head section, which is arranged in axially adjustable fashion in the edge region and has a larger cross section than the protrusion section, and an annular step, which is provided between the protrusion section and the head section. The annular step serves to realize a step changing cross section between the protrusion section and head section on the plunger. This annular step also provides the aforementioned portion of the plunger. In the protrusion section, the plunger has a maximum radial spacing to the edge region, whereas in the head section, there is a minimum spacing between the plunger and edge region. The greater the extent to which the plunger protrudes by way of its protrusion section into the cylindrical chamber, the greater the number of magnetic field lines that can enter the plunger from the edge region via the head section, thus increasing the efficiency of the acting magnetic forces. In this embodiment, the aforementioned gap has an annular form and encircles the protrusion section of the plunger.

In another advantageous embodiment, the plunger may be coupled by way of a diverting lever to a drive shaft, which is connected rotationally conjointly to the pinion, for the purpose of axially adjusting said drive shaft, such that, during the transfer of the pinion from the passive position into the active position, the plunger extends to an increasing depth into the cylindrical chamber. In other words, for the axial deployment of the pinion relative to the motor, the plunger is retracted relative to the coil arrangement.

In one advantageous refinement, it may now be provided that, in the active position of the pinion, the abovementioned annular step is arranged axially between the edge region of the face side wall and the face end of the cylindrical section.

Another refinement is particularly advantageous in which, in the active position, the annular step bears axially against the face end. In other words, the annular step forms, with the face end, an axial abutment for the plunger on the plunger stop. This has the result that, in the passive position, the above-described free space between the plunger and solenoid housing, or the interruption of a direct magnetic flux from the solenoid housing via the plunger to the plunger stop, is minimized. If the annular step comes to bear axially against the face end, said free space is eliminated, and the abovementioned interruption is eliminated. It is then possible for the magnetic field lines to run, in effect without interruption, from the solenoid housing via the plunger into the plunger stop.

In another advantageous embodiment, it may be provided that an axial face side, arranged in the cylindrical chamber, of the plunger bears axially against a base, which axially delimits the cylinder chamber, of the plunger stop when the pinion is adjusted into its active position. In this case, the face side of the plunger forms an axial abutment with the base of the plunger stop. An embodiment is however preferable in which the abovementioned annular step defines the abutment with the face side of the plunger stop, whereas an axial gap remains between the face side of the plunger and the base of the plunger stop.

In another embodiment, the cylindrical section may have a cylindrical wall which borders the cylindrical chamber. Said cylindrical wall is accordingly situated radially between the plunger and the coil arrangement.

A refinement is then advantageous in which the cylindrical wall has at least one recess which is delimited in the circumferential direction and which extends radially and/or axially at least over a part of the cylindrical wall. It is preferable for two or more such recesses to be provided which are arranged in particular in symmetrical or uniformly distributed fashion in the circumferential direction. A significant reduction of the magnetic field density is realized in the region of said recesses, whereas the field line density is increased in the remaining sections of the cylindrical wall. By means of the design of the cylindrical wall, it is thus possible for the profile of the magnetic field lines to be influenced.

In an alternative embodiment, the cylindrical wall may surround the cylindrical chamber in closed encircling fashion in the circumferential direction and with a constant wall thickness.

In another advantageous embodiment, the plunger may, at least in an axial section which protrudes into the cylindrical chamber, be of hollow form such that a cylindrical plunger wall surrounds a cavity in the plunger. In one refinement, said plunger wall may surround the cavity in closed encircling fashion in the circumferential direction and with a constant wall thickness. Alternatively, in this case, too, an embodiment is conceivable in which the plunger wall has at least one recess which is delimited in the circumferential direction and which extends radially and/or axially at least over a part of the plunger wall. It is preferable for two or more such recesses to be provided which are arranged in particular in symmetrical or uniformly distributed fashion in the circumferential direction. In this case, too, the profile of the magnetic field lines can be influenced by means of the design of the plunger wall.

In another embodiment, the plunger may be mounted in axially adjustable fashion in a guide sleeve which extends coaxially through the coil interior and which is supported radially on the cylindrical section. The adjustability of the plunger relative to the plunger stop and/or relative to the solenoid housing is simplified by way of the guide sleeve, which is preferably composed of a non-magnetic material.

In an advantageous refinement, the coil arrangement may be radially supported radially at the inside on the guide sleeve. In addition or alternatively, it may be provided that the edge region of the face side wall is radially supported radially at the inside on the guide sleeve.

In another advantageous embodiment, it may be provided that the plunger is connected by way of a switching rod to a contact element for the electrical connection of two electrical contacts which connect the electric motor to a main electrical supply of the electric motor. In this case, the switching rod is expediently led coaxially through the plunger stop, such that the plunger stop is situated axially between the plunger and the contact element. In this way, the plunger performs a dual function, as it serves firstly for the adjustment of the pinion between the active position and the passive position, while at the same time also serving for the control or switching of the electrical contacts and thus of the main electrical supply of the electric motor. The electric motor is supplied with electrical energy by way of said main electrical supply as soon as the pinion has reached the active position. Only then does the electric motor drive the pinion with the high torques required for the starting of the internal combustion engine.

In an advantageous refinement, at least one restoring spring may be provided between the plunger and the cylindrical section, which at least one restoring spring is arranged coaxially with respect to the switching rod and may expediently project axially into a recess formed in the plunger and/or into a recess formed in the cylindrical section. In the event of a deactivation of the coil arrangement or deenergization of the coil arrangement, the restoring spring effects an automatic deployment of the plunger out of the coil interior in order to adjust the pinion back into the passive position. By means of the restoring spring, it is also possible to realize a more failsafe design (failsafe principle).

In another advantageous refinement, it may be provided that, in the passive position, the contact element bears axially against a face end, facing away from the plunger, of the plunger stop. In this way, the contact element is provided with an additional function, as it defines the intended relative position of the plunger for the passive position of the pinion.

In another advantageous embodiment, the coil arrangement may have a coil support which has a cylindrical body and two end discs, between which at least one electrical coil of the coil arrangement is arranged radially at the outside. In this way, the coil support and the at least one coil form a pre-assemblable structural unit which can be mounted on the plunger stop, in order for the plunger stop with the coil structural unit mounted thereon to be inserted into the solenoid housing.

In one refinement, the coil support may bear by way of one of its end discs axially against an annular step of the plunger stop. This simplifies the realization of a structural unit composed of coil support with at least one coil and plunger stop. This plunger stop structural unit can be inserted particularly easily into the solenoid housing.

At least two different electrical coils may be mounted on the coil carrier. For example, a retraction coil and a holding coil may be provided which may be arranged axially separately on the coil carrier or else may be arranged radially one inside the other. It is likewise conceivable for the two coils to form a double winding.

Further important features and advantages of the invention will emerge from the subclaims, from the drawings and from the associated description of the figures on the basis of the drawings.

It is self-evident that the features mentioned above and the features yet to be discussed below may be used not only in the respectively specified combination but also in other combinations or individually, without departing from the scope of the present invention.

Preferred exemplary embodiments of the invention are illustrated in the drawings and will be discussed in more detail in the following description, wherein the same reference signs are used to denote identical or similar or functionally identical components.

DETAILED DESCRIPTION

Figure 1:
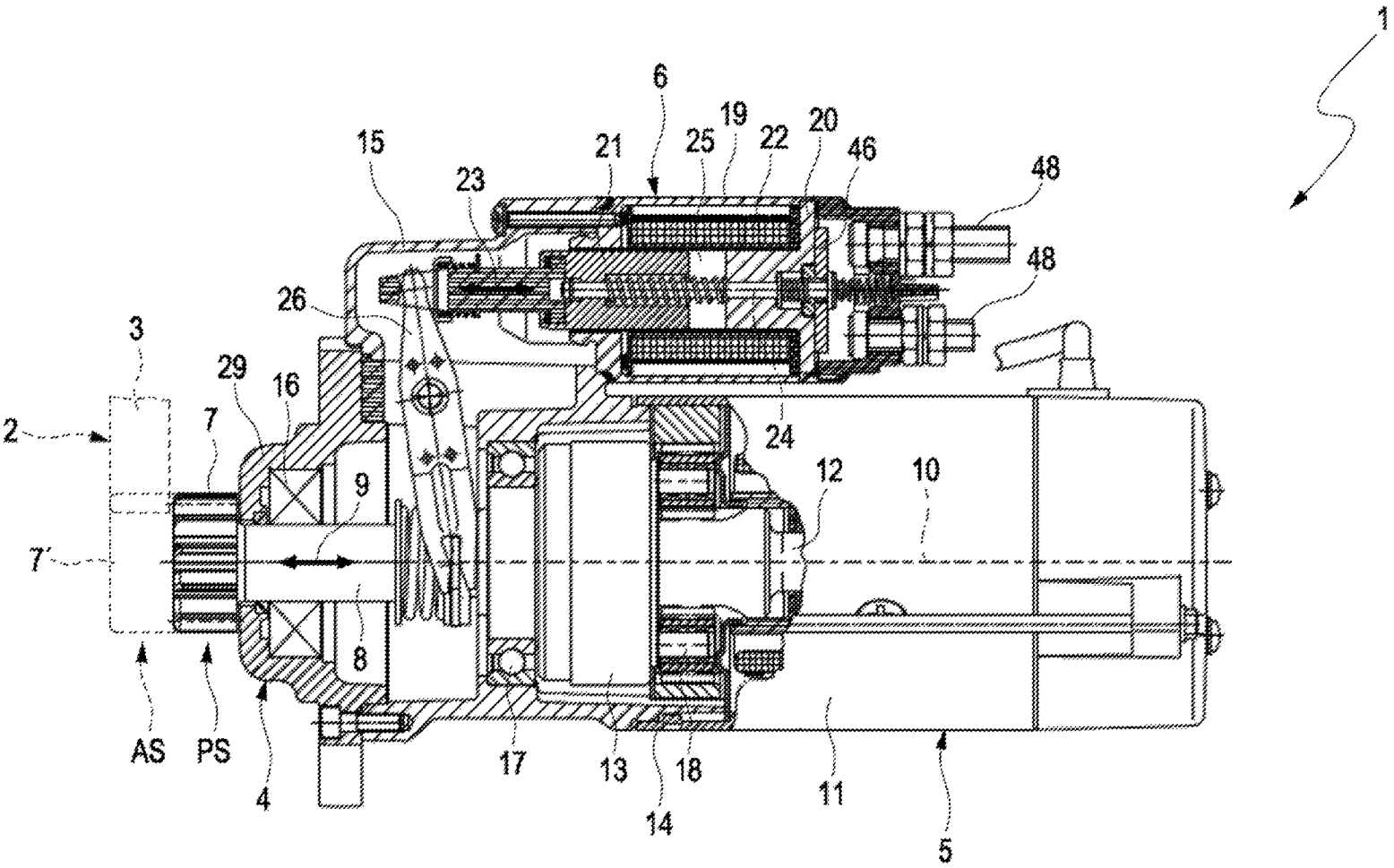
FIG. 1 shows a side view, partially in longitudinal section, of a starter with a conventional solenoid drive.

In accordance with FIG. 1, a starter 1 which is provided for starting an internal combustion engine 2, of which, in FIG. 1, only a gearwheel 3 is indicated by way of dashed lines, comprises a support 4, an electric motor 5 and a solenoid drive 6. The gearwheel 3 is incorporated in a suitable manner into a drivetrain (not shown in any more detail here) of the internal combustion engine 2, such that said gearwheel is connected in terms of drive to a crankshaft of the internal combustion engine 2 if the internal combustion engine 2 is, as is preferred, a piston engine with a crankshaft. The gearwheel 3 may for example be formed on a flywheel of the drivetrain.

The support 4 is designed for fastening the starter 1 to the internal combustion engine 2 or to a peripheral of the internal combustion engine 2 which may be situated for example in a vehicle which is equipped with the internal combustion engine 2.

The electric motor 5 is arranged on the support 4 and serves for driving a pinion 7 in rotation. The pinion 7 serves for driving the gearwheel 3 when the internal combustion engine 2 is to be started by way of the starter 1. For this purpose, the pinion 7 can, together with a drive shaft 8 on which the pinion 7 is rotationally conjointly arranged, be adjusted bilinearly in an axial direction 9, which is defined by an axis of rotation 10 of the drive shaft 8 or of the electric motor 5, between a passive position PS, which is shown in FIG. 1 by solid lines, and an active position AS, which is indicated in FIG. 1 by dashed lines. In said active position AS, the pinion is denoted by the reference sign 7'. In the active position AS, the pinion 7' serves for driving the gearwheel 3 and thus meshes with the latter such that a rotation of the pinion 7' forces a rotation of the gearwheel 3. In the passive position PS, the pinion 7 is axially offset with respect to the active position AS, specifically to such an extent that it does not mesh with the gearwheel 3. In this respect, the pinion 7 is then arranged axially spaced apart from the gearwheel 3.

The electric motor 5 furthermore has, in the conventional manner, an external stator 11 and an internal rotor 12, wherein the rotor 12 is connected in terms of drive to the drive shaft 8 by way of a transfer device 13. The transfer device 13 may have a clutch, in particular a one-way friction clutch. The transfer device 13 may additionally or alternatively have a gear transmission 18, in particular a planetary gear train. The stator 11 is accommodated in a stator housing 14 which is fastened to the support 4. In the situation shown, the support 4 has a base housing 29, which serves for the fastening of the starter 1 to said peripheral, and an intermediate housing 15, which is fastened to the base housing 29. In the example shown, the stator housing 14 is now fastened to said intermediate housing 15.

The drive shaft 8 is mounted by way of a main bearing 16 on the support 4 or on the base housing 29 thereof. A further bearing 17 is provided in the intermediate housing 15 for additional support of the drive shaft 8.

The solenoid drive 6 has a solenoid housing 19 which is fastened to the support 4, specifically to the intermediate housing 15 thereof. The solenoid drive 6 serves for the axial adjustment of the pinion 7. For this purpose, the solenoid drive 6 has a plunger stop 20 which is static with respect to the support 4, a plunger 21 which is axially adjustable relative to the plunger stop 20, and a cylindrical coil arrangement 22. An axial direction 23 of the axial adjustability of the plunger 21 is defined by a longitudinal central axis 24 of the solenoid drive 6. The solenoid drive 6 is expediently arranged on the support 4 so as to be parallel and adjacent to the electric motor 5, such that the longitudinal central axis 24 extends parallel to the axis of rotation 10.

The coil arrangement 22 is arranged on the plunger stop 20 and surrounds a cylindrical coil interior 25 in a circumferential direction about the longitudinal central axis 24. The plunger 21 is coupled by way of a diverting lever 26 to the drive shaft 8 such that, for the adjustment of the pinion 7 from the passive position PS into the active position AS, the plunger 21 is retracted into the coil interior 25. Accordingly, the coil arrangement 22 is in the form of a retraction coil which, when energized, pulls the plunger 21 into the coil interior 25. The diverting lever 26 in this case effects a reversal of the movement direction, such that the retraction of the plunger 21 toward the right in FIG. 1 effects a deployment of the pinion 7 toward the left in FIG. 1.

Figure 2:
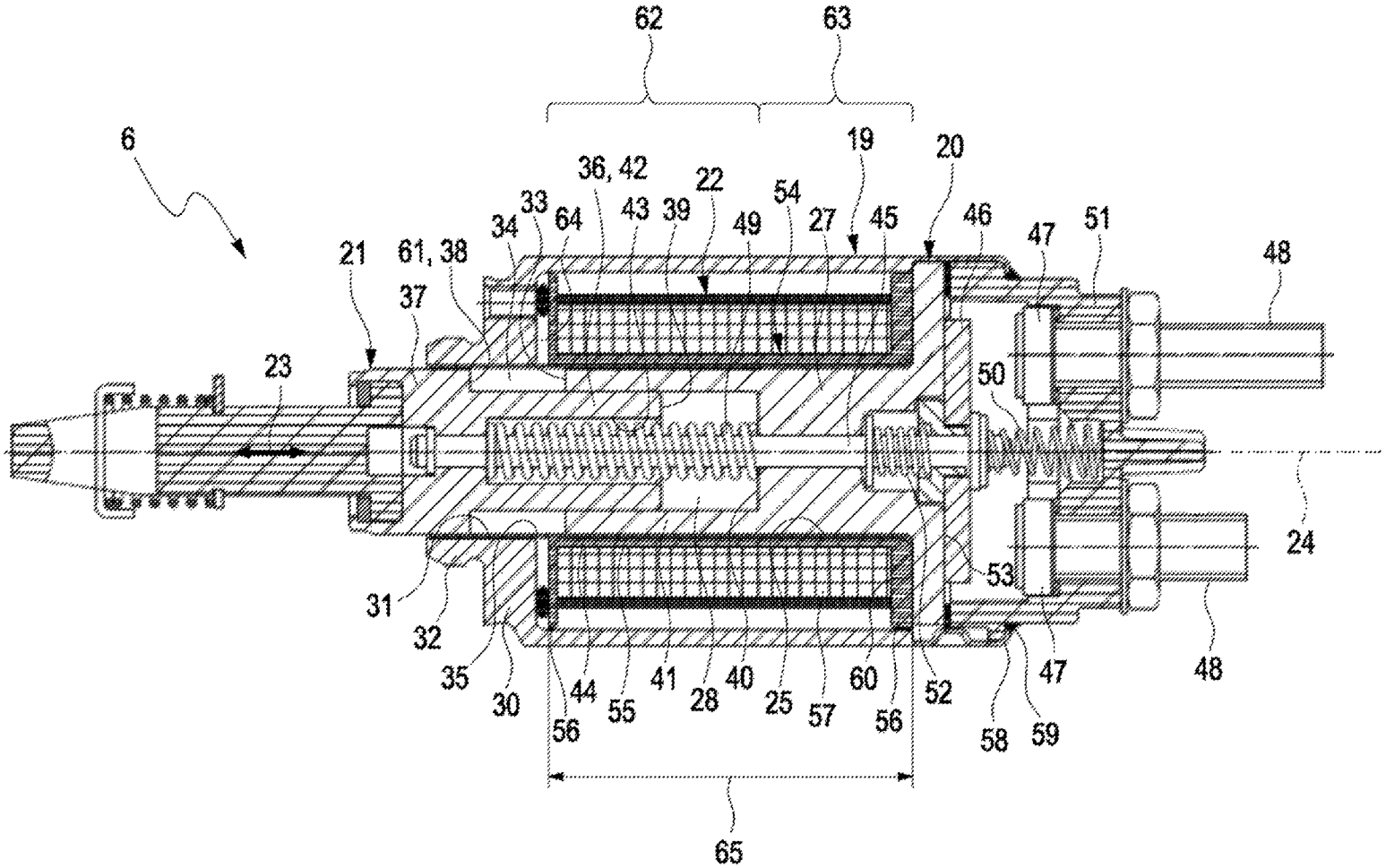
FIG. 2 shows a longitudinal section through a solenoid drive according to the invention.

As per FIG. 2, the plunger stop 20 of the solenoid drive 6 has a cylindrical section 27 which projects axially into the coil interior 25. In said cylindrical section 27 there is furthermore formed a cylindrical chamber 28 which is arranged coaxially with respect to the coil interior 25 and into which the plunger 21 protrudes axially. This relationship is not evident in the case of the conventional solenoid drive 6 shown in FIG. 1.

The solenoid housing 19 has, on a side facing toward the plunger 21, a face side wall 30 which has a passage opening 31 extended through axially by the plunger 21. The plunger stop 20 and the coil arrangement 22 are accommodated in the solenoid housing 19. The face side wall 30 has an edge region 32 which surrounds the passage opening 31 in the circumferential direction. Said edge region 32 is in this case spaced apart axially from a face end 33, facing toward the face side wall 30, of the cylindrical section 27.

There is thus a gap 34 between the face end 33 and the edge region 32 and thus between the plunger stop 20 and the solenoid housing 19. In the passive position PS said gap 34 results in a reduced density of field lines, which extend through the plunger 21 to the plunger stop 20, of a magnetic field that is generated when the coil arrangement 22 is energized. The density of the field lines is considerably greater within the solenoid housing 19 and within the plunger stop 20. For this purpose, the solenoid housing 19, the plunger 21 and the plunger stop 20 are expediently composed of a magnetically conductive material, preferably of a ferromagnetic material, in particular of an iron material. Owing to the reduced field line density in the plunger 21 in the passive position PS, it is the case at the start of an adjustment movement of the plunger 21 that the magnetic force which acts on the plunger 21 and which pulls the plunger 21 into the coil interior 25 is reduced.

According to FIG. 2 the coil interior 25 is axially divided into two half sections, namely a proximal half section 62 and a distal half section 63, wherein said proximal half section 62 is arranged closer to the face side wall 30 of the solenoid housing 19 than the distal half section 63. Furthermore, the face end 33 of the cylindrical section 27 is arranged in the proximal half section 62 of the coil interior 25. AS can be seen in FIG. 2, at least in the passive position PS of the pinion 7, the axial gap 34 is provided between said face end 33 of the cylindrical section 27 and a portion 61 of the plunger 21. When the plunger 21 is moving in order to move the pinion 7 from the passive position PS into the active position AS said portion 61 of the plunger 21 moves towards said face end 33 of the cylindrical section 27 in order to axially reduce said gap 34. Furthermore, said gap 34 is arranged proximal to the face side wall 30 of the solenoid housing 19. Preferably, the face side wall 30 has an inner side 64 facing towards the coil arrangement 22. In the passive position PS of the pinion 7, said gap 34 axially overlaps a radially inner edge 35 of said inner side 64.

To support this aspect, it is the case in FIG. 2 that the plunger 21 has a stepped design such that it has a protrusion section 36 and a head section 37 which transition into one another via an annular step 38. The protrusion section 36 is coordinated with the cylindrical chamber 28, such that said protrusion section 36 can protrude axially into said cylindrical chamber 28. To this end, the protrusion section 36 is preferably formed as a cylindrical body. By contrast, the head section 37 has a larger cross section than the protrusion section 36, wherein the annular step 38 defines a cross-sectional step. It is expediently possible for the annular step 38 to be positioned on the plunger 21 such that, in the active position AS of the pinion 7, that is to say when the plunger 21 is fully retracted, said annular step 38 is arranged axially between the edge region 32 and the face end 33. In this way, the abovementioned gap 34 is reduced in size by way of the head section 37. As a result, the field line density passed from plunger 21 to plunger stop 20 increases as the plunger 21 protrudes to an increasing extent into the cylindrical chamber 28. An embodiment is particularly advantageous in which the annular step 38 is positioned axially on the plunger 21 such that, in the active position AS, said annular step 38 comes to bear axially against the face end 33 and thus, in effect, forms an axial abutment for the plunger 21. In this case, in the active position AS, the abovementioned gap 34 is completely closed, whereby a maximum field line density is attained in said region, such that it is possible with relatively little electrical current to realize a relatively high holding force for the plunger 21 in the active position.

The plunger 21 has, on its protrusion section 36, an axial face side 39 which is arranged in the cylindrical chamber 28 and which is situated axially opposite a base 40, which axially delimits the cylindrical chamber 28, of the plunger stop 20. Depending on the positioning of the annular step 38, it is possible, in the active position AS, for the face side 39 to come to bear against the base 40 and form an axial abutment for the plunger 21. If the annular step 38 defines the axial abutment, the face side 39 has an axial spacing to the base 40 even in the active position AS. By contrast, if the face side 39 defines the axial stop, the annular step 38 has an axial spacing to the face end 33 in the active position AS. In a specific embodiment, it may be provided that, in the active position AS of the pinion 7, the annular step 38 bears axially against the face end 33 and the face side 39 bears axially against the base 40.

The cylindrical section 27 has a cylindrical wall 41 which surrounds the cylindrical chamber 28 in the circumferential direction. Here, an embodiment is preferable in which said cylindrical wall 41 surrounds the cylindrical chamber 28 in closed encircling fashion in the circumferential direction and with a constant wall thickness. It is however alternatively also possible for an embodiment to be provided in which said cylindrical wall 41 has at least one recess which is delimited in the circumferential direction and which extends radially and/or axially over at least a part of the cylindrical wall 41. For example, the cylindrical wall 41 may thus have a varying wall thickness and/or interruptions in the circumferential direction. This duly yields a varying distribution of the magnetic field lines 35 in the circumferential direction, but the overall density of the field lines 35 in the region of the 34 can be set in targeted fashion in this way.

The plunger 21 may be of hollow cylindrical form at least in an axial section which protrudes into the cylindrical chamber 28, said axial section being formed in this case by the protrusion section 36. Accordingly, in the protrusion section 36, the plunger 21 has a cylindrical plunger wall 42 which surrounds a cavity 43 in the circumferential direction. In this case, too, an embodiment is preferred in which said plunger wall 42 surrounds the cavity 43 in closed encircling fashion in the circumferential direction and with a constant wall thickness. As an alternative to this, an embodiment is also conceivable in which said plunger wall 42 has at least one recess which is delimited in the circumferential direction and which extends radially and/or axially at least over a part of the plunger wall 42. Accordingly, it is also possible in this case for said plunger wall 42 to have a varying wall thickness and/or at least one interruption in the circumferential direction. Thus, it is possible in this way, too, to realize a field line density which varies in the circumferential direction, which altogether improves a targeted setting of the field line density in the region of the gap 34.

The solenoid drive 6 is furthermore equipped with a guide sleeve 44 in which the plunger 21 is mounted in axially adjustable fashion. For this purpose, the guide sleeve 44 extends coaxially through the coil interior 25. Furthermore, the guide sleeve 44 is supported radially on the cylindrical section 27. Furthermore, the coil arrangement 22 is supported radially at the inside on said guide sleeve 44. Also, the edge region 32 of the face side wall 30 is supported radially at the inside on the guide sleeve 44. The head section 37 of the plunger 21 slides along the guide sleeve 44. By contrast, the protrusion section 36 slides along the cylindrical wall 41 of the cylindrical section 27.

The edge region 32 is in the form of a cylindrical sleeve. In this case, an axial length of the sleeve-shaped edge region 32 is greater than the axial adjustment travel of the plunger 21 covered by the latter between the active position AS and the passive position PS. In this case, depending on the embodiment of the abovementioned axial abutment, said adjustment travel corresponds to the axial spacing between the annular step 38 and the face end 33 and/or the axial spacing between the face side 39 and base 40.

The plunger 21 is furthermore coupled to a switching rod 45 which, for this purpose, at least partially extends through the plunger 21. The switching rod 45 serves for the axial adjustment of a contact element 46 which, in turn, serves for the electrical connection of two electrical contacts 47. By way of said electrical contacts 47, the electric motor 5 is connected to a main electrical supply 48. In other words, when the contact element 46 electrically connects the two electrical contacts 47 to one another, the electric motor 5 can be supplied, by way of the main electrical supply 48, with a rated electrical power in order that the electric motor 5 can output a rated torque at the pinion 7. To realize a so-called "soft-start process", it is possible for a considerably lower level of electrical power to be supplied to the electric motor 5 in order for the pinion 7 to be driven with a considerably lower torque for as long as it has not yet reached its active position AS. To this end usually the electrical power supply (not shown here) of the coil arrangement 22 is also used to operate the electric motor 5.

The switching rod 45 is led coaxially through the plunger stop 20. Accordingly, the plunger stop 20 is ultimately situated axially between the plunger 21 and the contact element 46. The plunger 21 is assigned at least one restoring spring 49 which, in the example, extends coaxially around the switching rod 45. In this case, the restoring spring 49 is supported at one side on the plunger 21 and at the other side on the plunger stop 20. In this case, the restoring spring 49 protrudes into the cavity 43. In this way, it is possible overall for an axially larger restoring spring 49 to be accommodated, whereby in particular, it is possible to realize a spring characteristic curve which is linear over the entire adjustment travel of the plunger 21. The maximum of said adjustment travel is the axial spacing between the plunger end 39 and the base 40.

The switching rod 45 is also assigned a restoring spring 50 which is supported at one side on the switching rod 45 and at the other side on a contact housing 51 on which the electrical contacts 47 are situated. Furthermore, a preload spring 52 may be provided which drives the contact element 46 in the direction of the contacts 47. Said preload spring 52 is in this case supported on the switching rod 45. As can be seen, an axial spacing between the contact element 46 and the contacts 47 is smaller than the overall travel of the plunger 21 between the passive position PS and the active position and AS. Thus, the contact element 46 comes into contact with the contacts 47 shortly before the active position AS is reached. When the active position AS is reached, the preload spring 52 then effects preloaded abutment of the contact element 46 against the contacts 47. Owing to the capacitive action of the coils/windings of the electric motor 5, the rated torque is built up after a time delay. Coordination is preferably performed such that the rated torque is present approximately at the same time as the active position AS is reached.

It can also be seen that, in the passive position PS, the contact element 46 bears axially against a face end 53, facing away from the plunger 21, of the plunger stop 20.

In the example shown here, the coil arrangement 22 has a coil carrier 54 which has a cylindrical body 55 and two end discs 56. The cylindrical body 55 extends coaxially with respect to the longitudinal central axis 24. The end discs 56 are expediently of planar form and extend annularly and perpendicular to the longitudinal central axis 24. Radially at the outside around the cylindrical body 55 and axially between the end discs 56, the coil arrangement 22 has at least one electrical coil 57. For example, it is possible for at least two different electrical coils 57 to be provided, specifically at least one retraction coil and at least one holding coil.

The coil arrangement 22 expediently performs a pre-assemblable coil structural unit in which the respective coil 57 is wound on the coil carrier 54. Furthermore, the plunger stop 20, guide sleeve 44 and coil arrangement 22 likewise form a pre-assemblable plunger stop structural unit which can be inserted in the preassembled state into the solenoid housing 19. Said plunger stop structural unit can also comprise the plunger 21, the switching rod 45, the contact element 46 and the respective springs 49, 52. Subsequently, the contact housing 51 can also be inserted and fixed for example by means of a flange connection 58 and/or by means of an adhesive connection 59.

In the assembled state, the coil carrier 54 bears by way of its end disc 56, shown on the right in FIG. 2, against an annular step 60 of the plunger stop 20.

According to FIG. 2 the cylindrical section 27 of the plunger stop 20 extends over more than 50% of an axial length 65 of the coil arrangement 22. Preferably, the cylindrical section 27 extends over more than 75% of the axial length 65 of the coil arrangement 22. In the depicted example, the cylindrical section 27 extends over more than 90% of the axial length 65 of the coil arrangement 22. The axial length 65 of the coil arrangement 22 is the distance between axial outer sides of the two end discs 56 of the coil carrier 54 which is a part of the coil arrangement 22, said axial outer sides of the two end discs 56 are axially turned away from each other.

The invention claimed is:

1. A starter for an internal combustion engine, comprising:

a support;

an electric motor arranged on the support for driving a pinion in rotation;

a solenoid drive arranged on the support configured to axially adjust the pinion between an active position for driving a gearwheel of an internal combustion engine, and a passive position axially offset with respect to the active position;

wherein the solenoid drive has a ferromagnetic solenoid housing coupled to the support, a ferromagnetic plunger stop arranged one of in and at the solenoid housing, a ferromagnetic plunger axially adjustable relative to the plunger stop and extending axially through a passage opening of a face side wall of the solenoid housing, and a cylindrical coil arrangement arranged in the solenoid housing and surrounding a cylindrical coil interior of the coil arrangement in a circumferential direction;

wherein the plunger stop has a cylindrical section projecting axially into the coil interior; and wherein the cylindrical section has a face end facing towards the face side wall and includes a cylindrical chamber, the plunger protruding axially into the cylindrical chamber when the pinion is in each of the active position and the passive position.

2. The starter according to claim 1, wherein:

the coil interior includes a proximal half section and a distal half section, the proximal half section disposed closer to the face side wall than the distal half section; and the face end of the cylindrical section is arranged in the proximal half section of the coil interior.

3. The starter according to claim 1, wherein the cylindrical section extends over more than 50% of an axial length of the coil arrangement.

4. The starter according to claim 3, wherein the cylindrical section extends over at least 75% of the axial length of the coil arrangement.

5. The starter according to claim 1, wherein:

at least when the pinion is in the passive position, an axial gap is defined between the face end of the cylindrical section and a portion of the plunger;

an axial distance of the gap is reduced when the pinion is adjusted from the passive position to the active position and the portion of the plunger is adjusted towards the face end of the cylindrical section; and the gap is arranged proximal to the face side wall.

6. The starter according to claim 5, wherein the face side wall has an inner side facing towards the coil arrangement and, when the pinion is in the passive position, the gap axially overlaps at least substantially completely a radially inner edge of the inner side.

7. The starter according to claim 5, wherein:

the plunger includes a protrusion section protruding axially into the cylindrical chamber, and a head section arranged in axially adjustable fashion in an edge region bordering the passage opening in a circumferential direction, the head section having a larger cross-sectional area than a cross-sectional area of the protrusion section; and the portion of the plunger is an annular step arranged between the protrusion section and the head section.

8. The starter according to claim 1, wherein the plunger is coupled via a diverting lever to a drive shaft connected rotationally conjointly to the pinion for axially adjusting the drive shaft, such that, during an adjustment of the pinion from the passive position into the active position, the plunger extends to an increasing depth into the cylindrical chamber.

9. The starter according to claim 7, wherein, when the pinion is in the passive position, the annular step is arranged axially outside of the coil interior.

10. The starter according to claim 7, wherein, when the pinion is in the active position, the annular step bears axially against the face end.

11. The starter according to claim 7, wherein an axial face side of the plunger arranged in the cylindrical chamber bears axially against a base of the plunger stop, and the base of the plunger stop axially delimits the cylinder chamber when the pinion is adjusted into the active position.

12. The starter according to claim 7, wherein the cylindrical section includes a cylindrical wall bordering the cylindrical chamber.

13. The starter according to claim 12, wherein one of:

the cylindrical wall includes at least one recess delimited in a circumferential direction and extending at least one of radially and axially at least over a part of the cylindrical wall; and the cylindrical wall surrounds the cylindrical chamber in a closed encircling fashion in a circumferential direction and with a constant wall thickness.

14. The starter according to claim 1, wherein the plunger is, at least in an axial section protruding into the cylindrical chamber, cylindrically hollow such that a cylindrical plunger wall surrounds a cavity.

15. The starter according to claim 14, wherein the plunger wall surrounds the cavity in a closed encircling fashion in a circumferential direction and with a constant wall thickness.

16. The starter according to claim 14, wherein the plunger wall includes at least one recess delimited in a circumferential direction and extending at least one of radially and axially at least over a part of the plunger wall.

17. The starter according to claim 7, wherein:

the plunger is arranged in an axially adjustable fashion in a guide sleeve extending coaxially through the coil interior and supported radially on the cylindrical section;

the coil arrangement is supported radially at an inside on the guide sleeve; and the edge region is supported radially at an inside on the guide sleeve.

18. A starter for an internal combustion engine, comprising:

a support;

an electric motor arranged on the support for driving a pinion in rotation;

a solenoid drive arranged on the support configured to axially adjust the pinion between an active position for driving a gearwheel of an internal combustion engine, and a passive position axially offset with respect to the active position, the solenoid drive including:

a ferromagnetic solenoid housing coupled to the support;

a ferromagnetic plunger stop arranged one of in and at the solenoid housing;

a ferromagnetic plunger axially adjustable relative to the plunger stop and extending axially through a passage opening of a face side wall of the solenoid housing; and a cylindrical coil arrangement arranged in the solenoid housing and surrounding a cylindrical coil interior of the coil arrangement in a circumferential direction;

wherein the plunger stop has a cylindrical section projecting axially into the coil interior, the cylindrical section having a face end facing towards the face side wall;

wherein, at least when the pinion is in the passive position, an annular gap extending axially between the face end of the cylindrical section and a portion of the plunger is defined, the gap at least partially disposed radially between the plunger and the face side wall; and wherein an axial distance of the gap is reduced when the pinion is adjusted from the passive position to the active position and the portion of the plunger is adjusted towards the face end of the cylindrical section.

19. A starter for an internal combustion engine, comprising:

a support;

an electric motor arranged on the support for driving a pinion in rotation;

a solenoid drive arranged on the support configured to axially adjust the pinion between an active position for driving a gearwheel of an internal combustion engine, and a passive position axially offset with respect to the active position, the solenoid drive including:

a ferromagnetic solenoid housing coupled to the support;

a ferromagnetic plunger stop arranged one of in and at the solenoid housing;

a ferromagnetic plunger axially adjustable relative to the plunger stop and extending axially through a passage opening of a face side wall of the solenoid housing, the plunger including a head section and a protrusion section protruding axially from the head section towards the plunger stop, the head section having a greater radial extent than the protrusion section defining an annular step; and a cylindrical coil arrangement arranged in the solenoid housing and surrounding a cylindrical coil interior of the coil arrangement in a circumferential direction;

wherein the plunger stop has a cylindrical section projecting axially into the coil interior, the cylindrical section including a cylindrical wall projecting axially towards the plunger stop and having a face end facing towards the face side wall, at least a portion of the cylindrical wall disposed radially between the coil arrangement and the protrusion section such that the protrusion section is arranged within a cylindrical chamber defined by the cylindrical wall.

20. The starter according to claim 19, further comprising a guide sleeve extending coaxially through the coil interior, the guide sleeve arranged on a radially inner side of the coil arrangement and on a radially inner surface of an edge region of the face side wall circumferentially surrounding the passage opening, wherein the head section slides axially along the guide sleeve and the protrusion section slides axially along the cylindrical wall when the pinion is adjusted from one of the active position and the passive position to the other of the active position and the passive position.

* * * * *